US007591977B2

(12) United States Patent
Ikeda et al.

(10) Patent No.: US 7,591,977 B2
(45) Date of Patent: Sep. 22, 2009

(54) HIGH STRENGTH AND LOW YIELD RATIO COLD ROLLED STEEL SHEET AND METHOD OF MANUFACTURING THE SAME

(75) Inventors: Shushi Ikeda, Kobe (JP); Hiroshi Akamizu, Kobe (JP); Koichi Makii, Kobe (JP); Yoichi Mukai, Kakogawa (JP); Koichi Sugimoto, Ueda (JP)

(73) Assignee: Kabuhsiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 428 days.

(21) Appl. No.: 11/044,185

(22) Filed: Jan. 28, 2005

(65) Prior Publication Data

US 2005/0161134 A1 Jul. 28, 2005

(30) Foreign Application Priority Data

Jan. 28, 2004 (JP) ..... 2004-019701

(51) Int. Cl.
*C22C 38/02* (2006.01)
*C22C 38/04* (2006.01)
*C22C 38/06* (2006.01)

(52) U.S. Cl. ..... 420/120; 148/230

(58) Field of Classification Search ..... 420/120; 148/320

See application file for complete search history.

(56) References Cited

U.S. PATENT DOCUMENTS

| | | | | |
|---|---|---|---|---|
| 4,640,872 | A * | 2/1987 | Irie et al. | 428/659 |
| 4,854,976 | A | 8/1989 | Era et al. | |
| 6,306,527 | B1 | 10/2001 | Ikeda et al. | |
| 6,316,127 | B1 | 11/2001 | Ikeda et al. | |
| 6,319,338 | B1 * | 11/2001 | Kawano et al. | 148/328 |
| 2003/0084966 | A1 | 5/2003 | Ikeda et al. | |
| 2004/0007298 | A1 | 1/2004 | Akamizu et al. | |
| 2004/0035500 | A1 | 2/2004 | Ikeda et al. | |
| 2004/0074575 | A1 | 4/2004 | Kashima et al. | |
| 2004/0159373 | A1 | 8/2004 | Ikeda et al. | |
| 2004/0226635 | A1 | 11/2004 | Ikeda et al. | |
| 2005/0161134 | A1 | 7/2005 | Ikeda et al. | |

FOREIGN PATENT DOCUMENTS

| | | | |
|---|---|---|---|
| EP | 0 974 677 | A1 | 1/2000 |
| EP | 1 207 213 | A1 | 5/2002 |
| EP | 1 365 037 | A1 | 11/2003 |
| EP | 1 391 526 | A2 | 2/2004 |
| JP | 5-331591 | | 12/1993 |
| JP | 10-237547 | * | 9/1998 |
| JP | 2000-282175 | | 10/2000 |
| JP | 2001-140035 | | 5/2001 |
| JP | 2003-89843 | | 3/2003 |
| JP | 2003-171735 | | 6/2003 |
| JP | 2003-321738 | | 11/2003 |
| JP | 2004-190050 | | 7/2004 |

OTHER PUBLICATIONS

ASM International, Materials Park, Ohio, Properties and Selection: Irons, Steels, and High Performance Alloys, "Classification and Designation of Carbon and Low Alloy Steels", pp. 144-145, Mar. 1990.*

U.S. Appl. No. 11/044,185, filed Jan. 28, 2005, Ikeda, et al.

U.S. Appl. No. 11/030,100, filed Jan. 7, 2005, Akamizu, et al.

Koh-ichi Sugimoto, et al., "Ductility of 0.1-0.6C-1.5Si-1.5Mn Ultra High-strength TRIP-aided Sheets Steels with Bainitic Ferrite Matrix", ISIJ International, vol. 44, No. 9, 2004, pp. 1608-1614.

Koh-ichi Sugimoto, et al., "Strength-flangeability of a High-strength TRIP Type Bainitic Sheet Steel", ISIJ International, vol. 40, No. 9, pp. 920-926.

Shunichi Hashimoto, et al., "Effect of Morphology of Retained Austenite on Strength and Ductility of TRIP-aided Steel Sheets", Tetsu-To-Hagane, vol. 88, No. 7, 2002, pp. 42-47 (with English Abstract).

U.S. Appl. No. 11/110,716, filed Apr. 21, 2005, Ikeda, et al.

U.S. Appl. No. 11/290,640, filed Dec. 1, 2005, Ikeda, et al.

U.S. Appl. No. 11/910,029, filed Sep. 28, 2007, Akamizu, et al.

U.S. Appl. No. 11/910,013, filed Sep. 28, 2007, Kashima, et al.

U.S. Appl. No. 11/874,516, filed Oct. 18, 2007, Ikeda, et al.

U.S. Appl. No. 12/303,566, filed Dec. 5, 2008, Nakaya, et al.

U.S. Appl. No. 12/303,634, filed Dec. 5, 2008, Nakaya, et al.

U.S. Appl. No. 12/305,998, filed Dec. 22, 2008, Saito, et al.

* cited by examiner

*Primary Examiner*—Roy King
*Assistant Examiner*—Jessee R. Roe
(74) *Attorney, Agent, or Firm*—Oblon, Spivak, McClelland, Maier & Neustadt, L.L.P.

(57) ABSTRACT

To provide a high strength and low yield ratio cold rolled steel sheet having high elongation property and high flange drawing property, or a plated steel sheet made by plating the same. The high strength and low yield ratio cold rolled steel sheet or the plated steel sheet made by plating the same has such a constitution as 0.10 to 0.25% of C, 1.0 to 2.0% of Si and 1.5 to 3.0% of Mn, are contained in terms of weight percentage, while other elements are controlled such as Al within 0.2%, P within 0.15% and S within 0.02%, with residual austenite occupying at least 5%, bainitic ferrite occupying at least 60% (preferably 80% or more), and polygonal ferrite within 20% (containing 0%), so that a tensile strength is 980 MPa or higher, while an elongation (El in %), a flange drawing property ($\lambda$in %), a tensile strength (TS in MPa) and a yield strength (YP in MPa) satisfy the following inequality (1): $[(El \times \lambda \times TS)/YP] \geqq 645$.

9 Claims, 2 Drawing Sheets

No1

×4000

No3

×4000

HIGH STRENGTH AND LOW YIELD RATIO COLD ROLLED STEEL SHEET AND METHOD OF MANUFACTURING THE SAME

BACKGROUND OF THE INVENTION

1. Technical Field

The present invention relates to a high strength and low yield ratio cold rolled steel sheet (including a plated steel sheet) having high elongation property and flange drawing property, and a method of manufacturing the same. More particularly, it relates to a high strength cold rolled steel sheet that has high tensile strength (TS) of 980 MPa or higher, high elongation property and flange drawing property such that [elongation property (El)×flange drawing property (λ)/yield ratio (%)] is 645 or higher, and a low yield ratio, a plated steel sheet made by plating the high strength cold rolled steel sheet, and a method of manufacturing the same.

The steel sheet of the present invention can be utilized in wide fields of industry including automobile, electric apparatuses and machinery. Description that follows will deal with a case of using the steel sheet of the present invention in the manufacture of automobile bodies, as a typical application.

2. Background Art

There are increasing demands for high-strength steel sheets for the purpose of improving the fuel efficiency through weight reduction of the steel sheets used in automobiles and improving the safety in the event of collision. Recently, calls for the reduction of exhaust gas emission based on concerns about the global environment add to the demands.

However, high-strength steel sheets are still required to have high workability for forming, so as to be formed in various shapes in accordance to the application. In an application where the steel sheet is pressed into a complicated shape, in particular, there is a strong demand for a high-strength steel sheet that combines satisfactory elongation property and flange drawing property.

A high-strength steel sheet developed to meet such needs is described in Japanese Unexamined Patent Publication (Kokai) No. 2003-89843 which discloses such a technology that improves elongation property and flange drawing property at the same time by forming the matrix phase structure substantially constituted from single phase of ferrite where precipitates containing V and Mo are dispersed. However, this technology is intended for the manufacture of steel sheets having tensile strength in a range from 600 to 750 MPa, and does not aim at the improvement of elongation property and flange drawing property in high strength region above 980 MPa.

A high-strength steel sheet known to have high ductility is residual austenite steel sheet made by forming residual austenite (γR) in the structure and causing induced transformation of γR (strain-induced transformation: TRIP) during forming step thereby improving the ductility.

For example, Japanese Unexamined Patent Publication (Kokai) No. 5-331591 discloses that satisfactory strength-ductility balance and low yield ratio can be achieved by forming the matrix phase structure from a mixture of ferrite containing the precipitation of ϵ-Cu and martensite or a mixture of martensite and residual austenite. Although this technology achieves improvements in elongation and yield ratio in high strength region above 980 MPa, it does not achieve sufficient flange drawing property and strength-ductility balance.

Japanese Unexamined Patent Publication (Kokai) No. 2001-140035 discloses that high ductility and high flange drawing property can be achieved by forming a composite structure containing ferrite in proportion of 30% or more in a volume ratio, residual austenite of 2% or more and low-temperature transformation phase (non-tempered martensite or bainite) in the steel sheet after annealing, while making ferrite gains finer. However, this technology is not intended for steel sheets in high strength region above 980 MPa, and addresses tensile strength in a range from 600 to 700 MPa.

Japanese Unexamined Patent Publication (Kokai) No. 2003-321738 describes that difference in hardness between soft ferrite phase and hard phase can be reduced so as to improve the flange drawing property without causing a decrease in ductility due to ferrite, by forming the matrix from a composite structure constituted from three phases of ferrite, bainite and residual austenite or four phases containing martensite in addition to the three phases, and causing dispersed precipitation of carbide containing Ti and Mo satisfying a formula. Japanese Unexamined Patent Publication (Kokai) No. 2000-282175 describes that crack initiating points can be reduced during a forming step thereby to achieve better strength-ductility balance and a low yield ratio without decreasing the strength, by forming a structure consisting of a principal phase constituted from bainite in a volume ratio from 60 to 90% and a second phase constituted from at least one kind of pearlite, ferrite, residual austenite and martensite.

However, technologies disclosed in Japanese Unexamined Patent Publication (Kokai) No. 2003-321738 and Japanese Unexamined Patent Publication (Kokai) No. 2000-282175 are related to hot-rolled steel sheets where the carbide mentioned above is precipitated during take-up step, and it is difficult to implement such technology in the manufacture of cold-rolled steel sheet. Elongation property and flange drawing property become lower as the sheet thickness decreases, and it is difficult to achieve the levels of elongation property and flange drawing property comparable to those of the hot-rolled steel sheet, in a cold rolled steel sheet that is usually thinner than the hot-rolled steel sheet.

The present inventors also have been conducting a research aimed at improving the elongation property and the flange drawing property of high strength cold rolled steel sheet. Accordingly, the present inventors proposed a steel sheet having matrix phase containing tempered martensite in a volume ratio of 15% or higher to the entire structure containing ferrite, and a second phase containing residual austenite in a volume ratio of 5 to 30% to the entire structure containing 0.8% or more C (for example, Japanese Unexamined Patent Publication (Kokai) No. 2003-171735). However, further improvements are required in order to improve the elongation property and the flange drawing property and reduce the yield ratio in steel sheets of higher strength.

THE SUMMARY OF THE INVENTION

The present invention has been made with the background described above, and an object thereof is to provide a high strength cold rolled steel sheet that has high elongation property, high flange drawing property and low yield ratio, a plated steel sheet obtained by plating the former, and a method of manufacturing the same.

The high strength and low yield ratio cold rolled steel sheet according to the present invention that has high elongation property and flange drawing property has such a constitution as 0.10 to 0.25% (hereinafter concentrations of elements are all in mass percentage) of C, 1.0 to 2.0% of Si and 1.5 to 3.0% of Mn, while the Al content is preferably controlled within 0.2%, P content is preferably controlled within 0.15% and S content is preferably controlled within 0.02%, wherein the microscopic structure is constituted from at least 5% of residual austenite, at least 60% (preferably 80% or more) of bainitic ferrite and 20% or less (containing 0%) of polygonal ferrite.

The cold-rolled steel sheet has a tensile strength of 980 MPa or higher, with an elongation property (El in %), a flange drawing property (λ in %), a tensile strength (TS in MPa) and a yield strength (YP in MPa) satisfying the following inequality (1).

$$[(El \times \lambda \times TS)/YP] \geqq 645 \quad (1)$$

The steel sheet of the present invention may also contain 0.5% or less (higher than 0%) of Ni, 0.5% or less (higher than 0%) of Cu, and may further contain 30 ppm or less (higher than 0 ppm) Ca and/or 30 ppm or less (higher than 0 ppm) REM.

The present invention also includes a plated steel sheet made by plating the cold steel sheet described above.

The present invention also provides a method of manufacturing the steel sheet described above, comprising a continuous annealing step or a plating step following a cold rolling step. The continuous annealing step or the plating step includes a carbide melting step where the temperature (T1) is maintained not lower than A3 point, a bainitic ferrite forming step where the temperature is lowered from T1 to bainite transformation temperature range (T2) under such a control that prevents the pearlite transformation from occurring, where it is preferable that the temperature is maintained in the bainite transformation temperature range (T2), wherein the bainite transformation temperature range (T2) is set in a range from 450 to 300° C. in the bainitic ferrite forming step and the mean cooling rate is set to 10° C./sec. or higher.

According to the present invention, a cold-rolled steel sheet constituted from at least 5% of residual austenite, at least 60% (preferably 80% or more) of bainitic ferrite and 20% or less (containing 0%) of polygonal ferrite in a volume ratio and a plated steel sheet based on the cold-rolled steel sheet are obtained, achieving a high strength of 980 MPa or higher, high elongation property, high flange drawing property and a low yield ratio. The cold-rolled steel sheet and the plated steel sheet can be used with high workability of forming in the manufacture of automobile parts and industrial machine parts that require high strength. The steel sheet of the present invention is capable of suppressing sufficiently the spring back after forming step because of the low yield ratio.

BRIEF DESCRIPTION OF THE DRAWINGS

In order to more fully understand the drawings used in the detailed description of the present invention, a bridge description of each drawing is provided.

DETAILED DESCRIPTION OF THE PREFERRED EMBODIMENTS

Figure 1:
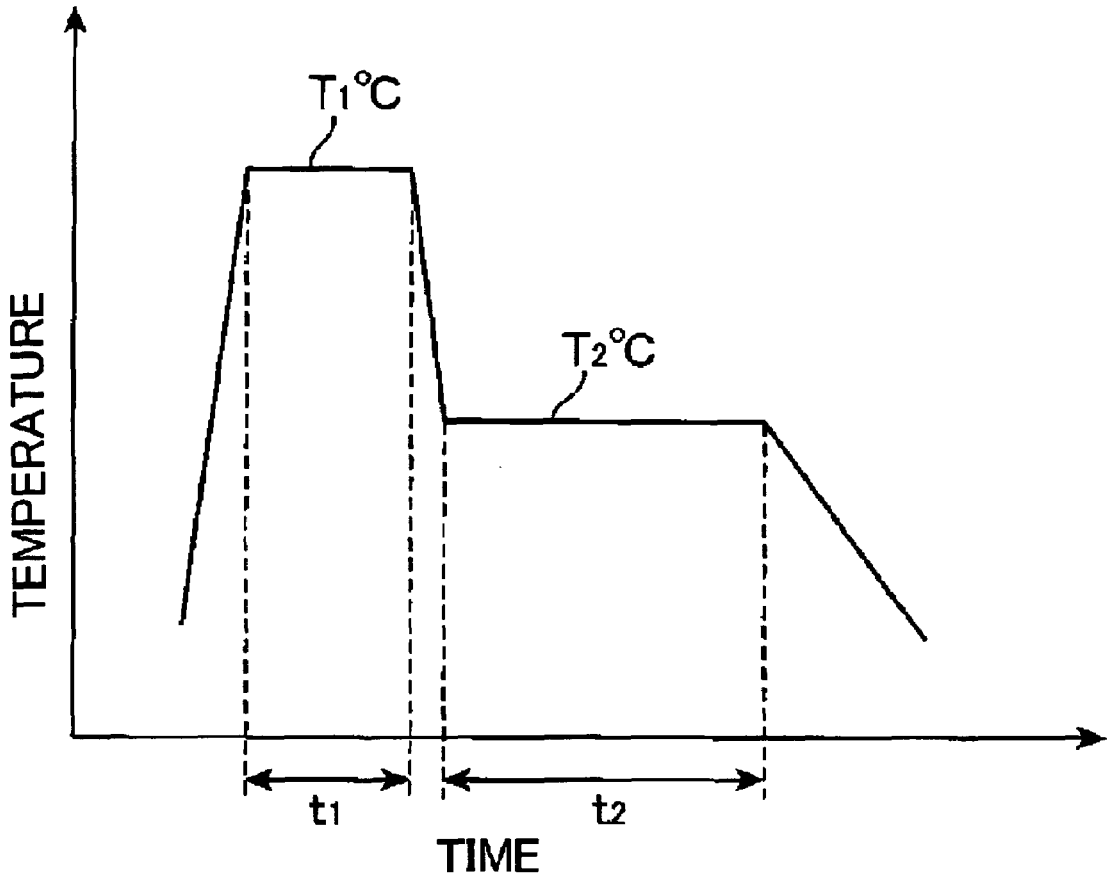
FIG. 1 is a diagram schematically showing a temperature changing pattern with a CAL simulator in an example.

The present inventors conducted a research aimed at achieving a high strength cold rolled steel sheet that has strength of 980 MPa or higher, high elongation property, high flange drawing property and low yield ratio under the various situations described above. The inventors then found that the objects can be achieved by forming such a structure as the matrix phase is constituted mainly from bainitic ferrite that has a low density of dislocations, specified amount of residual austenite exists, and generation of polygonal ferrite is suppressed, by controlling the proportions of the constituent elements and applying austempering treatment by a method described later, thereby developing the technology of the present invention. Reasons for specifying the matrix phase structure of the steel sheet and setting the proportion thereof will be described in detail below.

<Bainitic Ferrite: at Least 60%>

Most significant feature of the steel sheet of the present invention is that principal phase is constituted mainly from bainitic ferrite. TRIP steel sheet of the prior art has principal phase of polygonal ferrite or pearlite. In such a structure, polygonal ferrite is often contained in the form of blocks, resulting in a problem that island-like residual γ existing in boundaries of the bainitic ferrite blocks acts as the initiating point of destruction, thus making it impossible to ensure satisfactory flange drawing property. The metal structure that is based on bainitic ferrite according to the present invention, in contrast, can easily achieve high strength and high flange drawing property because of higher density of dislocations (initial dislocation density) than other types of structure. Moreover, adding austempering treatment (for example, cooling to the bainite transformation temperature range T2 and then holding the temperature for 180 to 600 seconds) to be described later decreases the dislocation density to a level lower than that of the conventional bainitic ferrite. Thus it is made possible to make a steel sheet that ahs sufficiently low yield ratio by controlling the dislocation density to a relatively low level among various types of bainitic ferrite.

In order to achieve such an effect, it is necessary to have bainitic ferrite occupying at least 60%, preferably 70% or more, and more preferably 80% or more of the structure. In order to suppress the creation of ferrite and make a steel sheet having satisfactory flange drawing property, it is recommended to control the structure so as to be constituted from substantially two phases of bainitic ferrite and residual γ.

The bainitic ferrite of the present invention is obviously different from bainite structure in that there is no carbide contained therein. It is also different from polygonal ferrite structure that has lower structure having very low or zero density of dislocation and polygonal ferrite structure that has lower structure such as fine sub-grains (refer to "Photo Library-1 of Bainite in Steel" published by The Iron and Steel Institute of Japan, Basic Research Group).

<Residual Austenite Structure (Residual γ): at Least 5%>

Residual γ is effective in improving the elongation property as described above, and fine residual γ formed in the bainitic ferrite grains contributes to the improvement of the flange drawing property. In order to make full use of this property, it is necessary to maintain residual γ occupying at least 5% of the structure. Proportion of the residual γ is controlled to preferably 8% or more, and more preferably 10% or more of the structure. Since excessive amount of the residual γ causes the flange drawing property to lower, proportion of the residual γ should be controlled within an upper limit of 30%, preferably 25%.

Content of C in the residual γ (CγR) is preferably 0.8% or higher in order to improve the elongation property.

<Polygonal Ferrite: 20% or Less (Containing 0%)>

The present invention improves elongation property and flange drawing property and decreases yield ratio of high-strength steel sheet by forming the structure that consists mainly of the bainitic ferrite described above and contains residual austenite. It was found that suppressing the creation of polygonal ferrite enables it to improve the flange drawing property of the steel sheet more reliably. Specifically, proportion of polygonal ferrite should be controlled within 20%, preferably within 10%, and most preferably to 0%.

<Other Phase: Pearlite, Bainite, Martensite (Containing 0%)>

The steel sheet of the present invention may be constituted either from only the structures described above (namely, a composite structure of bainitic ferrite and residual γ or a composite structure of bainitic ferrite, residual γ and polygonal ferrite), or may contain other structure such as pearlite, bainite and martensite that may remain in the manufacturing process of the present invention to such an extent that the effect of the present invention is not compromised. However, such additional components are preferably as low as possible.

Now the essential components of the steel sheet of the present invention will be described. Hereinafter concentrations of components are all given in terms of weight percentage.

<C: 0.10 to 0.25%>

C is an essential element for ensuring high strength and maintaining residual γ. Particularly it is important to contain a sufficient content of C in the γ phase, so as to maintain the desired γ phase to remain even at the room temperature. In order to make use of this action, it is necessary to contain 0.10% or more C content, preferably 0.12% or more and more preferably 0.15% or more. In order to ensure weldability, however, C content should be controlled to 0.25% or lower, preferably 0.23% or lower and more preferably 0.20% or lower.

<Si: 1.0 to 2.0%>

Si has an effect of suppressing the residual γ from decomposing and carbide from being created, and is also effective in enhancing solid solution. In order to make full use of this effect, it is necessary to contain Si in a concentration of 1.0% or higher, preferably 1.2% or higher. However, excessive content of Si does not increase the effect beyond saturation and leads to a problem such as hot rolling embrittlement. Therefore, the concentration is controlled within an upper limit of 2.0%, preferably within 1.8%.

<Mn: 1.5 to 3.0%>

Mn is an element required to stabilize γ and obtain the desired level of residual γ. In order to make full use of this effect, it is necessary to contain Mn in a concentration of 1.5% or higher, and preferably 2.0% or higher. However, containing Mn in a concentration higher than 3.0% causes adverse effects. The concentration is preferably controlled within 2.5%.

<Al: 0.2% or Lower>

A high concentration of Al leads to higher likelihood of the polygonal ferrite to be created, thus making it difficult to improve the flange drawing property enough. In order to suppress the creation of polygonal ferrite and improve the flange drawing property, it is effective to decrease the Al content, which is controlled to 0.2% or lower and preferably to 0.1% or lower according to the present invention.

<P: 0.15% or Lower)

P is an element that is effective in obtaining desired residual γ, and may therefore be contained. However, an excessive concentration of P adversely affects the workability. Thus the concentration of P is controlled to 0.15% or lower, and preferably within 0.1%.

<S: 0.02% or Lower>

S forms sulfide inclusion such as MnS that initiates crack and adversely affects the workability of the steel. Therefore, concentration of S is controlled within 0.02% and preferably within 0.015%.

While the steel of the present invention includes the elements described above as the fundamental components with the rest substantially consisting of iron, the following elements may be contained as impurities introduced by the stock material, tooling and production facilities: inevitable impurities such as N (nitrogen) and 0.01% or less O (oxygen), and also such element as Ni, Cu, Ca and REM (rare earth element) to the extent that does not adversely affect the effect of the invention.

Excessively high content of N results in the precipitation of much nitride which may lead to lower ductility. Thus concentration of N should be controlled to 60 ppm or less, preferably 50 ppm or less and more preferably 40 ppm or less. Although the concentration of N is preferably as low as possible, lower limit will be set to about 10 ppm in consideration of the practical possibility of reduction in an actual process.

<Ni: 0.5% or Lower (Higher Than 0%) and/or Cu: 0.5% or Lower (Higher Than 0%)

These elements are effective in strengthening the steel and stabilizing and securing the predetermined amount of residual γ. In order to make full use of this effect, it is preferable that Ni in concentration of 0.05% or higher (preferably 0.1% or higher) and/or Cu in concentration of 0.05% or higher (preferably 0.1% or higher) are contained. However, the effects described above reach saturation when more than 0.5% each of Ni and Cu are contained, resulting in economical disadvantage. It is more preferable to contain 0.4% or less Ni and 0.4% or less Cu.

<Ca: 30 ppm or Lower (Higher than 0 ppm) and/or REM: 30 ppm or Lower (Higher than 0 ppm)>

Ca and REM (rare earth element) are effective in controlling the form of sulfide in the steel and improve the workability of the steel. Sc, Y, La and the like may be used as the rare earth element in the present invention. In order to achieve the effect described above, it is recommended to add each of these elements in concentration of 3 ppm or higher (preferably 5 ppm or higher), However, the effects described above reach saturation when the concentration exceeds 30 ppm, resulting in economical disadvantage. It is more preferable to keep the concentration within 25 ppm.

In order to make the steel sheet of the present invention with high efficiency, it is very effective to carry out continuous annealing step or plating step under the following conditions after the cold rolling step.

(i) The temperature is maintained at A3 point or higher (T1) for 10 to 200 seconds.

(ii) The temperature is lowered from T1 to bainite transformation temperature range (T2: about 450 to 300° C.) under control to prevent the ferrite transformation and pearlite transformation from occurring, at a mean cooling rate of 10° C./sec. or higher.

(iii) The temperature is maintained in the temperature range described above (T2) for 180 to 600 seconds.

Soaking at the temperature of A3 point or higher (T1) is effective in completely melting carbide and forming the desired residual γ, and is also effective in forming bainitic ferrite in the cooling step after soaking. Duration of maintaining the temperature (T1) is preferably set in a range from 10 to 200 seconds. When the duration is shorter, the effect described above cannot be obtained enough, and longer duration results in the growth of coarse crystal grains. The duration is more preferably from 20 to 150 seconds.

Then the temperature is lowered from T1 to the bainite transformation temperature range (T2: about 450 to 300° C.) at a mean cooling rate of 10° C./sec. or higher, preferably 15° C./sec. or higher and more preferably 20° C./sec. or higher, under control to prevent the pearlite transformation from occurring. Specified amount of bainitic ferrite can be formed by controlling the mean cooling rate within the range described above through air cooling, mist cooling or by the use of water-cooled roll in the cooling step. While the mean cooling rate is desired to be as fast as possible and specific upper limit is not set, it is recommended to set the mean cooling rate at a proper level by taking the actual operation into consideration.

It is preferable to continue the control of cooling rate until the temperature reaches the bainite transformation temperature range (T2: about 450 to 300° C.), because it is difficult to generate residual γ and achieve satisfactory elongation when the control is concluded prematurely at a temperature higher than the temperature range (T2) and the steel is left to cool down very slowly. It is also not desirable to maintain the cooling rate described above till a temperature lower than the temperature range described above is reached, since it makes it difficult to generate residual γ and achieve satisfactory elongation property.

After cooling down to the bainite transformation temperature range (T2), it is preferable to maintain the temperature in the temperature range described above (T2) for 180 to 600 seconds. Maintaining the temperature in the range described above for 180 seconds enables it to concentrate C in the residual γ efficiently in a short period of time and obtain stable residual γ in sufficient amount, thus causing the TRIP effect by the residual γ to develop reliably. It also enables it to sufficiently restore the dislocations in ferrite and decrease the yield ratio. The temperature is maintained at T2 more preferably for 200 seconds or more, and further most preferably for 240 seconds or longer. When this duration exceeds 600 seconds, the TRIP effect by the residual γ cannot be achieved sufficiently, and therefore the duration is preferably limited within 480 seconds.

The heat treatment described above may be carried out by heating and cooling by means of CAL (actual facility), CAL simulator or the like.

There is no restriction on the method of cooling down the steel after maintaining the temperature described above to the room temperature, and water cooling, gas cooling, air cooling or the like may be employed. Plating or alloying treatment may also be carried out to such an extent that deviation from the desired metal structure and/or other adverse effect to the feature of the present invention would not be caused.

The steel sheet of the present invention can be manufactured through hot rolling step→cold rolling step→continuous annealing or plating step including the step described above.

There are no restrictions on the operating conditions of the hot rolling step and the cold rolling step, which may be carried out under conventionally employed conditions. It is considered to be more effective in achieving the desired structure of the steel sheet of the present invention to control the operation in the continuous annealing step or the plating step, than the hot rolling step and the cold rolling step.

Specifically, in the hot rolling step, such conditions may be employed as the steel sheet that has been hot rolled at a temperature of Ar3 point or higher is cooled at a mean cooling rate of about 30° C./sec. and is wound up at a temperature approximately from 500 to 600° C. In the cold rolling step, it is recommended to cold roll the steel at a rolling rate of 30 to 70%. It needs not to say that these conditions are not intended to be restrictive of the present invention.

The manufacturing processes under the conditions described above on the steel having the basic composition described above results in the rolled steel sheet that has the metal structure described above, a tensile strength of 980 MPa or higher, with an elongation (El in %), a flange drawing property (A in %), a tensile strength (TS in MPa) and a yield strength (YP in MPa) satisfying the following inequality (1). Specific examples of the composition and manufacturing conditions will be given in examples to be described later.

The steel sheet having the properties described above can be characterized with regard to the metal structure as one that contains the components and phases in proportions described above and dislocations of bainitic ferrite in the predetermined state. However, it is difficult to quantitatively determine that dislocations of bainitic ferrite in the predetermined state. It is also difficult to completely determine that the manufacturing conditions satisfy the conditions described above, because of the large number of the degrees of freedom in the manufacturing conditions. Accordingly, resultant characteristics are also taken into account in the present invention.

Among variations of the steel sheet of the present invention, one that gives 1000 or larger value for the left-hand side of the following inequality (1) has well-balanced flange drawing property and yield ratio and is preferable.

$$[(El \times \lambda \times TS)/YP] \geqq 645 \quad (1)$$

Now the present invention will be described in detail below by way of examples. It is understood, however, that the present invention is not limited by these examples, and various modifications that do not deviate from the spirit of the present invention described herein are all within the scope of the present invention.

EXAMPLES

Steel specimen having the compositions shown in Table 1 was made by melting so as to obtain a slab that was subjected to hot rolling. The hot rolling step was carried out by heating to 1100° C. and rolling the steel (finish rolling temperature 850° C.), winding up the steel sheet at 600° C., thereby to obtain a hot rolled steel sheet having thickness of 2.4 to 3.2 mm. The hot rolled steel sheet was then pickled and was then cold rolled (rolling ratio 50 to 70%), thereby to obtain a steel sheet having thickness of 1.0 to 1.6 mm.

In experiments Nos. 1 through 8 to be described later, heat treatment was applied in a continuous annealing line (CAL). Specifically, the steel sheet was maintained in a temperature range from 850 to 900° C. for a duration of 100 to 200 seconds, cooled forcibly at a cooling rate of 15 to 25° C./s to about 400° C., maintained in a temperature range from about 400 to 300° C. for about 5 minutes (300 seconds), and was then cooled down to the room temperature before being wound up.

A steel sheet was annealed under conditions different from those of the experiments Nos. 1 through 8, and the resultant steel sheet was evaluated. The slab of steel type No. 3 shown in Table 1 was used in the experiment, wherein hot rolling and cold rolling were applied under conditions similar to those described above to make steel sheet having thickness in a range from 1.0 to 1.6 mm, that was subjected to heat treatment with the temperature pattern schematically shown in FIG. 1 by using CAL simulator. Heat treatment conditions of the experiments Nos. 9 through 15 are shown in Table 1 (t1 in FIG. 1 was set to 90 seconds for all of the experiments Nos. 9 through 15). In every case, the steel that had been held at the transformation temperature was air-cooled to the room temperature and was subjected to skin pass with area reduction ratio of 0.5 to 2, before being wound up.

surface facing upward and was reamed by means of a 60° conical punch, thereby expanding the hole. Then the hole expanding ratio (λ) at the time when a crack penetrated through was measured (Japan Steel Industry Association Standard JFST 1001). Results of these experiments are shown in Table 2.

TABLE 1

| Steel type No. | Composition (mass %) C | Si | Mn | P | S | Al | N | Other components | Ac3 transformation point (° C.) |
|---|---|---|---|---|---|---|---|---|---|
| 1 | 0.080 | 1.85 | 2.45 | 0.03 | 0.006 | 0.030 | 0.0035 | — | 862 |
| 2 | 0.120 | 1.80 | 2.45 | 0.03 | 0.004 | 0.034 | 0.0041 | — | 847 |
| 3 | 0.199 | 1.21 | 2.21 | 0.02 | 0.004 | 0.033 | 0.0036 | — | 807 |
| 4 | 0.288 | 1.51 | 2.03 | 0.04 | 0.005 | 0.034 | 0.0034 | — | 808 |
| 5 | 0.205 | 0.30 | 2.40 | 0.04 | 0.004 | 0.030 | 0.0029 | — | 759 |
| 6 | 0.179 | 1.20 | 2.00 | 0.04 | 0.005 | 0.032 | 0.0035 | Ni: 0.2 | 824 |
| 7 | 0.183 | 1.21 | 1.98 | 0.03 | 0.006 | 0.033 | 0.0038 | Cu: 0.2 | 815 |
| 8 | 0.179 | 1.20 | 2.00 | 0.03 | 0.004 | 0.032 | 0.0039 | Ca: 10 ppm | 818 |

TABLE 2

| Experiment No. | Steel type No. | Manufacturing conditions: Heating temperature $T_1$ (° C.) | Cooling rate (° C./s) | Holding temperature $T_2$ (° C.) | Holding period $t_2$ (seconds) | Structure (Occupation ratio %): PF | Other than PF | (2) Residual γ | BF (1)-(2) | Properties: YP (MPa) | TS (MPa) | El (%) | λ (%) | YR (%) | (El × λ × TS)/YP |
|---|---|---|---|---|---|---|---|---|---|---|---|---|---|---|---|
| 1 | 1 | | Actual facility (FIG. 1) | | | 36 | 64 | 4.2 | 59.8 | 530 | 843 | 20.8 | 75 | 63 | 2481 |
| 2 | 2 | | Actual facility (FIG. 1) | | | 5 | 85 | 8.7 | 76.3 | 767 | 982 | 14.5 | 65 | 78 | 1207 |
| 3 | 3 | | Actual facility (FIG. 1) | | | 3 | 97 | 12.3 | 84.7 | 821 | 998 | 16.2 | 54 | 82 | 1063 |
| 4 | 4 | | Actual facility (FIG. 1) | | | 0 | 100 | 20.2 | 79.8 | 910 | 1175 | 14.1 | 32 | 77 | 583 |
| 5 | 5 | | Actual facility (FIG. 1) | | | 0 | 100 | 2.1 | 97.9 | 950 | 1003 | 8.7 | 55 | 95 | 505 |
| 6 | 6 | | Actual facility (FIG. 1) | | | 0 | 100 | 12.1 | 87.9 | 823 | 995 | 12.6 | 55 | 83 | 838 |
| 7 | 7 | | Actual facility (FIG. 1) | | | 0 | 100 | 11.7 | 88.3 | 834 | 1021 | 13.3 | 45 | 82 | 733 |
| 8 | 8 | | Actual facility (FIG. 1) | | | 0 | 100 | 12.0 | 88 | 801 | 998 | 16 | 60 | 80 | 1196 |
| 9 | 3 | 900 | 20 | 475 | 300 | 5 | 95 | 9.5 | 85.5 | 833 | 965 | 18.7 | 26 | 86 | 563 |
| 10 | 3 | 900 | 20 | 325 | 300 | 0 | 100 | 4.2 | 95.8 | 967 | 1068 | 10.2 | 55 | 91 | 620 |
| 11 | 3 | 900 | 20 | 400 | 300 | 0 | 100 | 11.5 | 88.5 | 803 | 1002 | 14.5 | 65 | 80 | 1176 |
| 12 | 3 | 900 | 5 | 400 | 300 | 70 | 30 | 1.3 | 28.7 | 842 | 876 | 13.4 | 15 | 96 | 209 |
| 13 | 3 | 900 | 20 | 400 | 120 | 0 | 100 | 8.3 | 91.7 | 970 | 1035 | 10.2 | 58 | 94 | 631 |
| 14 | 3 | 900 | 20 | 400 | 1000 | 0 | 100 | 4.3 | 95.7 | 920 | 945 | 12 | 43 | 97 | 530 |
| 15 | 3 | 800 | 10 | 400 | 300 | 86 | 14 | 11.1 | 2.9 | 821 | 965 | 17 | 15 | 85 | 300 |

Metal structures of the steel sheets made as described above were observed by means of leveler corrosion under an optical microscope and a scanning electron microscope (SEM). From the microscopic photograph, an areal ratio of polygonal ferrite (PF) and an areal ratio of structures other than polygonal ferrite (PF) (bainitic ferrite+residual γ) were determined. The proportion of the residual γ was determined by measuring the saturation magnetization. The proportion of bainitic ferrite (BF) was determined by subtracting the proportion of the residual γ from the areal ratio of structures other than polygonal ferrite (PF) that was determined from the photograph.

Tensile test was conducted by using JIS No. 5 test piece to measure yield strength (YP), tensile strength (TS) and elongation (total elongation El). Flange drawing property test was also conducted to evaluate the flange drawing property (λ).

The flange drawing property test was conducted by using a disk-shaped test piece measuring 100 mm in diameter and 1.0 to 1.6 mm in thickness. Specifically, after punching through a hole 10 mm in diameter, the disk was placed with the burred The results shown in Table 2 can be interpreted as follows. Every No. in the description that follows means the experiment No. given in Table 2.

Nos. 2, 3, 6 through 8 and 11 all satisfy the requirements of the present invention, and steel sheets of satisfactory properties were obtained. No. 11 was subjected to heat treatment by means of an actual facility (CAL) using CAL simulator, and a steel sheet of satisfactory properties was obtained also in this case.

Other examples where some of the requirements of the present invention is not satisfied have drawbacks as described below. No. 1 is a case that contains insufficient concentration of C, where the predetermined amount of residual γ could not be formed and excessive ferrite was contained, resulting in insufficient strength.

No. 4 is a case that contains excessive content of C, resulting in low flange drawing property and poor balance between the strength, elongation property, flange drawing property and yield ratio.

No. 5 is a case that contains insufficient concentration of Si, where required amount of residual γ could not be formed resulting in insufficient elongation. It showed a high yield ratio and poor balance between the strength, elongation property, flange drawing property and yield ratio.

Nos. 9, 10, 12 through 15 are examples where steel materials of the specified compositions were used, but the specified manufacturing method was not employed. As a result, either the metal structure satisfying the requirements could not be obtained, or the metal structure satisfied the requirements but satisfactory properties could not be obtained.

Among these, No. 9 experienced a transformation temperature that was too high during the austempering treatment. As a result, dislocations in the bainitic ferrite were lost, resulting in high hardness ratio (hardness of residual γ as the second phase/hardness of bainitic ferrite as the matrix phase) and low flange drawing property.

No. 10 experienced a transformation temperature that was too low during the austempering treatment, resulting in less proportion of residual γ and insufficient elongation.

No. 12 was cooled too slowly after being heated to a temperature of Ac3 point or higher, resulting in ferrite transformation and pearlite transformation without forming the desired structure. As a result, properties were unsatisfactory in any of strength, elongation property and flange drawing property and yield ratio.

No. 13 was maintained in the temperature from 450 to 300° C. for a shorter period of time, resulting in insufficient restoration of dislocations in the bainitic ferrite and in a higher yield ratio.

No. 14 was maintained in the temperature from 450 to 300° C. for a longer period of time, and the TRIP effect of the residual γ could not be developed enough.

No. 15 was heated to a temperature lower than Ac3 point similarly to the conventional manufacturing method of TRIP steel, and the desired structure could not be obtained while the flange drawing property was significantly low.

Figure 2:
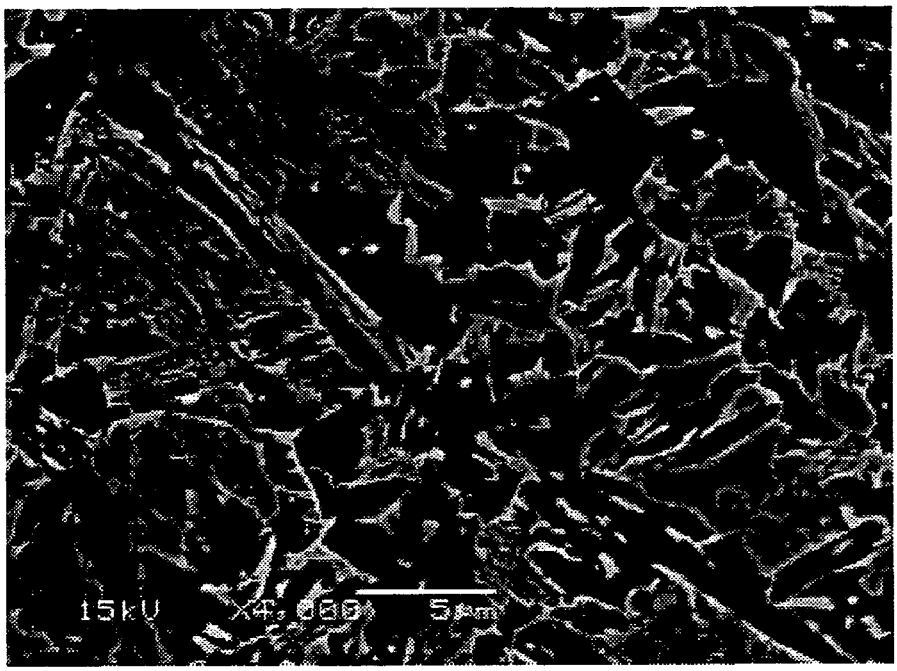
FIG. 2 is an SEM photograph of a steel sheet obtained in experiment No. 1.
Figure 3:
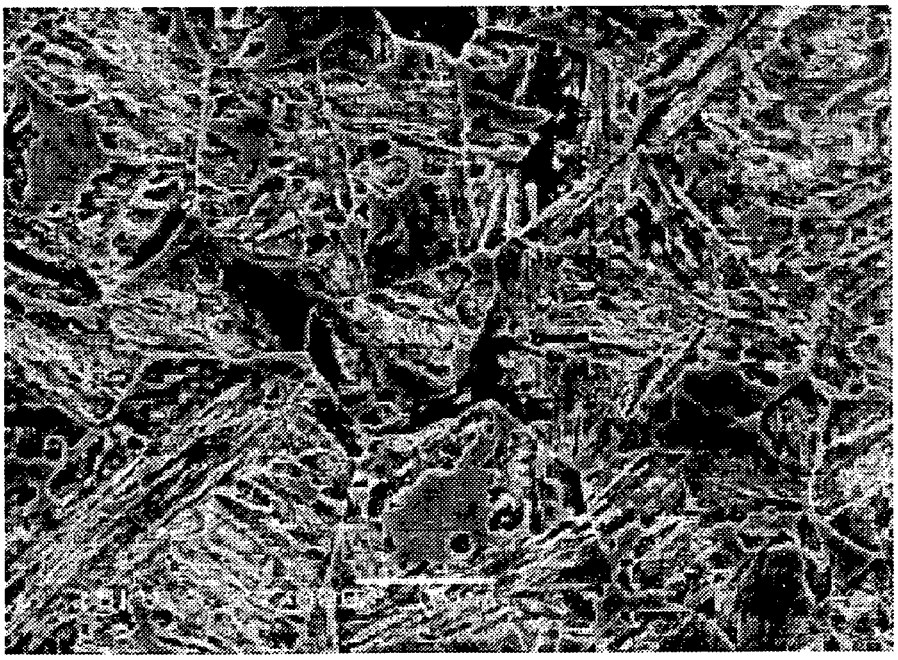
FIG. 3 is an SEM photograph of a steel sheet obtained in experiment No. 3.

SEM photographs of the steel sheets obtained in the examples are shown for reference. FIG. 2 shows an SEM photograph (magnification factor of 4000) showing the metal structure of the experiment No. 1 that is a comparative example. Black spots are ferrite grains and gray spots are bainitic ferrite or residual γ grains. It can be seen that ferrite structure is predominant and less bainitic ferrite is contained. FIG. 3 shows an SEM photograph (magnification factor of 4000) showing the metal structure of the experiment No. 3 that is an example of the present invention. It can be seen that bainitic ferrite identified by gray color forms the matrix phase.

A steel sheet according to the invention is used for members of a vehicle. Especially, the steel sheet is suitable for crush members, construction members such as center pillar reinforce and interior members such as seat frame and seat rail.

What is claimed is:

1. A high strength and low yield ratio cold rolled steel sheet having a high elongation property and a high flange drawing property, the steel sheet comprising:

0.10 to 0.25% by mass of C;

1.0 to 2.0% by mass of Si; and 1.5 to 3.0% by mass of Mn, wherein the steel sheet has a structure comprising at least 5% by volume of residual austenite;

at least 60% by volume of banitic ferrite; and

20% by volume or less (including 0%) of polygonal ferrite, and wherein the steel sheet has a tensile strength of 980 MPa or higher; and a total elongation measured using a JIS No. 5 test piece (El in %), a flange drawing property (λ in %), a tensile strength (TS in MPa) and a yield strength (YP in MPa) satisfy the inequality $[(El \times \lambda \times TS)/YP] \geqq 645$.

2. The cold rolled steel sheet according to claim 1, wherein the structure comprises 80% by volume or more of bainitic ferrite.

3. The cold rolled steel sheet according to claim 1, further comprising:

0.2% by mass or less (including 0%) of Al;

0.15% by mass or less (including 0%) of P; and 0.02% by mass or less (including 0%) of S.

4. The cold rolled steel sheet according to claim 1, further comprising at least one of:

0.5% by mass or less (excluding 0%) of Ni; and 0.5% by mass or less (excluding 0%) of Cu.

5. The cold rolled steel sheet according to claim 1, further comprising at least one of:

30 ppm by mass or less (excluding 0%) of Ca; and 30 ppm by mass or less (excluding 0%) of REM.

6. A plated steel sheet manufactured by plating the cold rolled steel sheet of claim 1.

7. A method of manufacturing a high strength and low yield ratio cold rolled steel sheet having a high elongation property and a high flange drawing property, the method comprising a step of cold rolling a steel sheet;

a subsequent continuous annealing step or a plating step; and a step of producing the cold rolled steel sheet of claim 1, wherein the continuous annealing step or the plating step includes:

a carbide melting step where the temperature is maintained at a level (T1) above an A3 point;

a bainitic ferrite forming step where the temperature is lowered from T1 to a bainite transformation temperature range (T2) under control to prevent a pearlite transformation from occurring; and a temperature holding step where the temperature is maintained at the bainite transformation temperature range (T2).

8. The manufacturing method according to claim 7, wherein in the bainitic ferrite forming step the bainite transformation temperature range (T2) is set in a range from 450 to 300° C. and a mean cooling rate is set to 10° C./sec. or higher.

9. The manufacturing method according to claim 7, wherein the temperature holding step is to maintain the temperature in the bainite transformation temperature range (T2) for a period from 180 to 600 seconds.

* * * * *

UNITED STATES PATENT AND TRADEMARK OFFICE

CERTIFICATE OF CORRECTION

PATENT NO. : 7,591,977 B2
APPLICATION NO. : 11/044185
DATED : September 22, 2009
INVENTOR(S) : Ikeda et al.

It is certified that error appears in the above-identified patent and that said Letters Patent is hereby corrected as shown below:

On the title page, Item (73), the Assignee information is incorrect. Item (73) should read:

-- (73) Assignee: Kabushiki Kaisha Kobe Seiko Sho (Kobe Steel, Ltd.), Kobe-shi (JP) --

Signed and Sealed this

Third Day of November, 2009

David J. Kappos

David J. Kappos
*Director of the United States Patent and Trademark Office*